United States Patent [19]

Alexander, III et al.

[11] 4,203,563

[45] May 20, 1980

[54] LOOM TAKE-UP CLOTH ROLL DOFFER

[75] Inventors: William J. Alexander, III, Mauldin; John S. Cooper, Fountain Inn; Charles E. Moore, Mauldin, all of S.C.

[73] Assignee: Alexander-Cooper, Inc., Mauldin, S.C.

[21] Appl. No.: 947,412

[22] Filed: Oct. 2, 1978

[51] Int. Cl.[2] ..... B65H 17/12

[52] U.S. Cl. ..... 242/66

[58] Field of Search ..... 242/66, 81, 65, 75.1, 242/68.7, 78.7, 79, 58.6

[56] References Cited

U.S. PATENT DOCUMENTS

| | | | |
|---|---|---|---|
| 1,904,255 | 4/1933 | Seeley | 242/66 |
| 3,178,125 | 4/1965 | Greding | 242/66 |

*Primary Examiner*—John M. Jillions

*Attorney, Agent, or Firm*—Bailey, Dority & Flint

[57] ABSTRACT

A doffing mechanism is illustrated wherein a cloth roll engagable means is normally carried in aligned laterally spaced relation to the cloth roll with driving means which are actuated by manually raising the cloth roll engaging means to be driven by the take-up mechanism in a reverse direction to forcefully move the cloth roll engaging means for doffing the full cloth roll into a cart positioned beside the take-up rolls for receiving and carrying away the cloth roll.

3 Claims, 2 Drawing Figures

LOOM TAKE-UP CLOTH ROLL DOFFER

BACKGROUND OF THE INVENTION

Cloth rolls when employed in connection with take-up apparatus of the type usually positioned in front of the loom utilizing a pair of parallel spaced rolls, are normally built to very large sizes, and often weigh on the order of two thousand pounds. The doffing of such heavy rolls requires special lifting mechanism with personnel assigned to utilize such equipment. The doffing apparatus of the present invention makes possible the doffing of the large cloth roll by regular personnel in a manual operation. The doffing equipment is simple in construction and design and requires little maintenance.

Accordingly, it is an important object of the present invention to simplify the doffing of large cloth rolls by use of inexpensive manually operated doffing mechanism.

Another important object of the invention is the provision of a doffing apparatus with few moving parts which is manually operable only at the time the doffing operation is required for removing cloth rolls into carts for removing the cloth rolls for subsequent finishing operations.

Still another important object of the present invention is to reduce equipment cost and maintenance while making it possible for regular weaving personnel to carry out the doffing operations related to very large loom cloth take-up rolls.

Apparatus has been employed heretofor which utilized fluid operated cylinders in connection with the doffing of the large rolls such as illustrated in U.S. Pat. No. 3,286,944. Such devices require the use of power operated mechanism and in the device illustrated in the patent, it is necessary to first remove the roll from the take-up or winding mechanism. The apparatus of the present invention on the other hand, removes the cloth roll from the take-up rolls.

SUMMARY OF THE INVENTION

It has been found that doffing apparatus may be provided for removing the large cloth rolls from loom take-ups by providing a manually engagable drive mechanism engagable with the take-up drive mechanism when operated in reverse direction for urging cloth roll engagable means into engagement with the cloth roll removing the cloth roll from the take-up.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
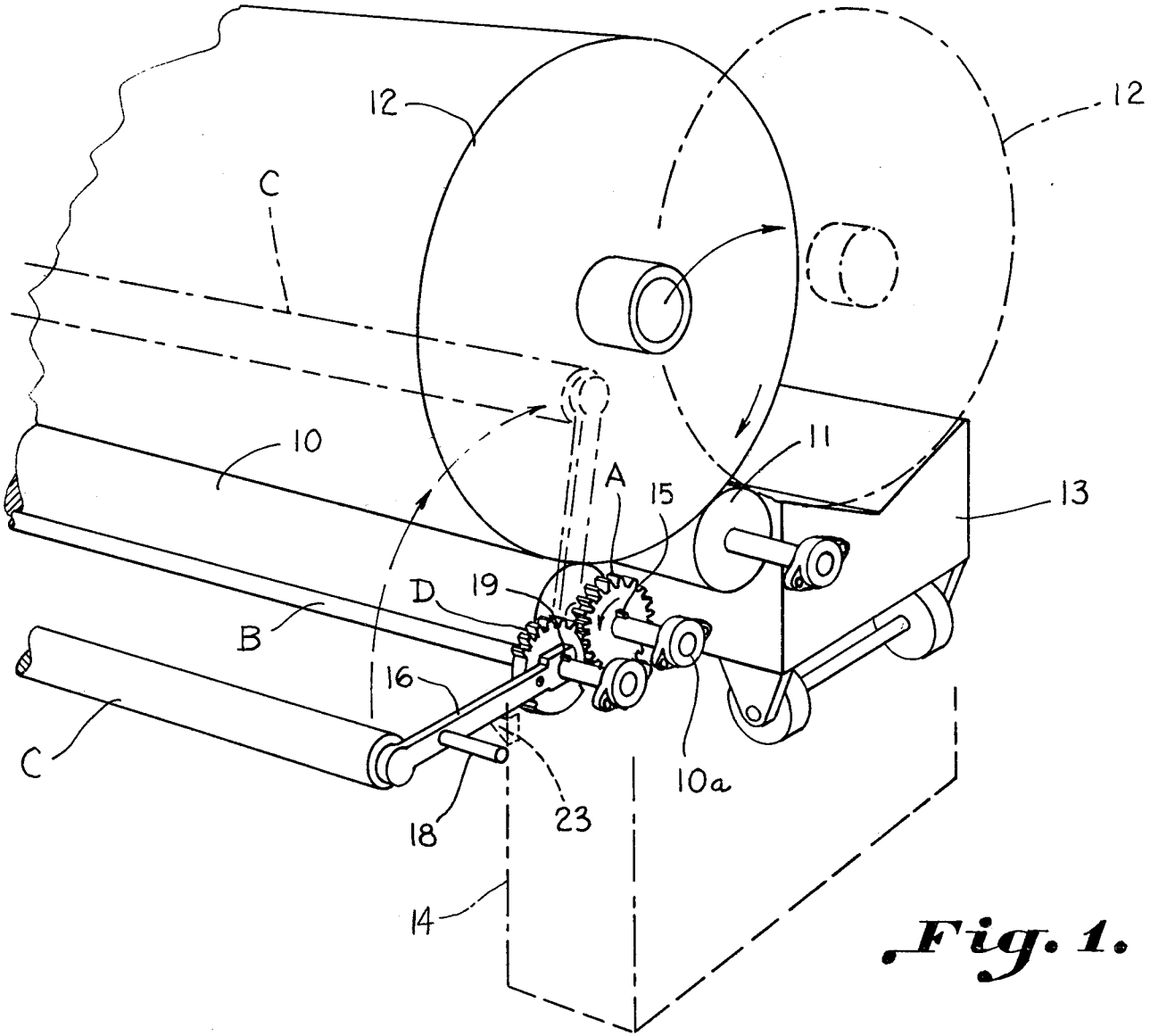
FIG. 1 is a perspective view illustrating a doffing apparatus constructed in accordance with the present invention positioned upon a loom take-up mechanism having driven spaced aligned rolls carried in front of a loom, the cloth roll having been fully built.

A doffing apparatus is illustrated for a loom take-up of the type having a pair of driven spaced aligned rolls supporting therebetween a cloth roll. The take-up is positioned in front of the loom and the cloth is fed thereto from the loom for winding into a large roll. A driving gear A is carried in driven relation to one of the spaced aligned rolls. A shaft B is carried for oscillation in alignment with the spaced aligned rolls. Cloth roll engaging means in the form of a doffing roll C is fixed in laterally spaced alignment with the shaft. A gear segment D is carried in fixed relation to the shaft. Thus, the gear segment D may be moved into engagement with the driving gear A urging the cloth roll engaging means C into engagement with the cloth roll, urging same out of its supported position between the spaced aligned rolls.

The loom cloth take-up includes a pair of driven spaced aligned take-up rolls 10 and 11. The take-up rolls support the cloth roll 12 which is illustrated herein as being fully wound or built and ready for doffing upon the cart 13. The frame member or stand 14, shown in broken lines, serves as a support for the take-up rolls 10 and 11. The driving gear A is illustrated as being fixed to the shaft 10*a* of the roll 10 as by a key 15 so as to be driven thereby. The shaft B is supported for rotation upon the stand 14 at one end.

Figure 2:
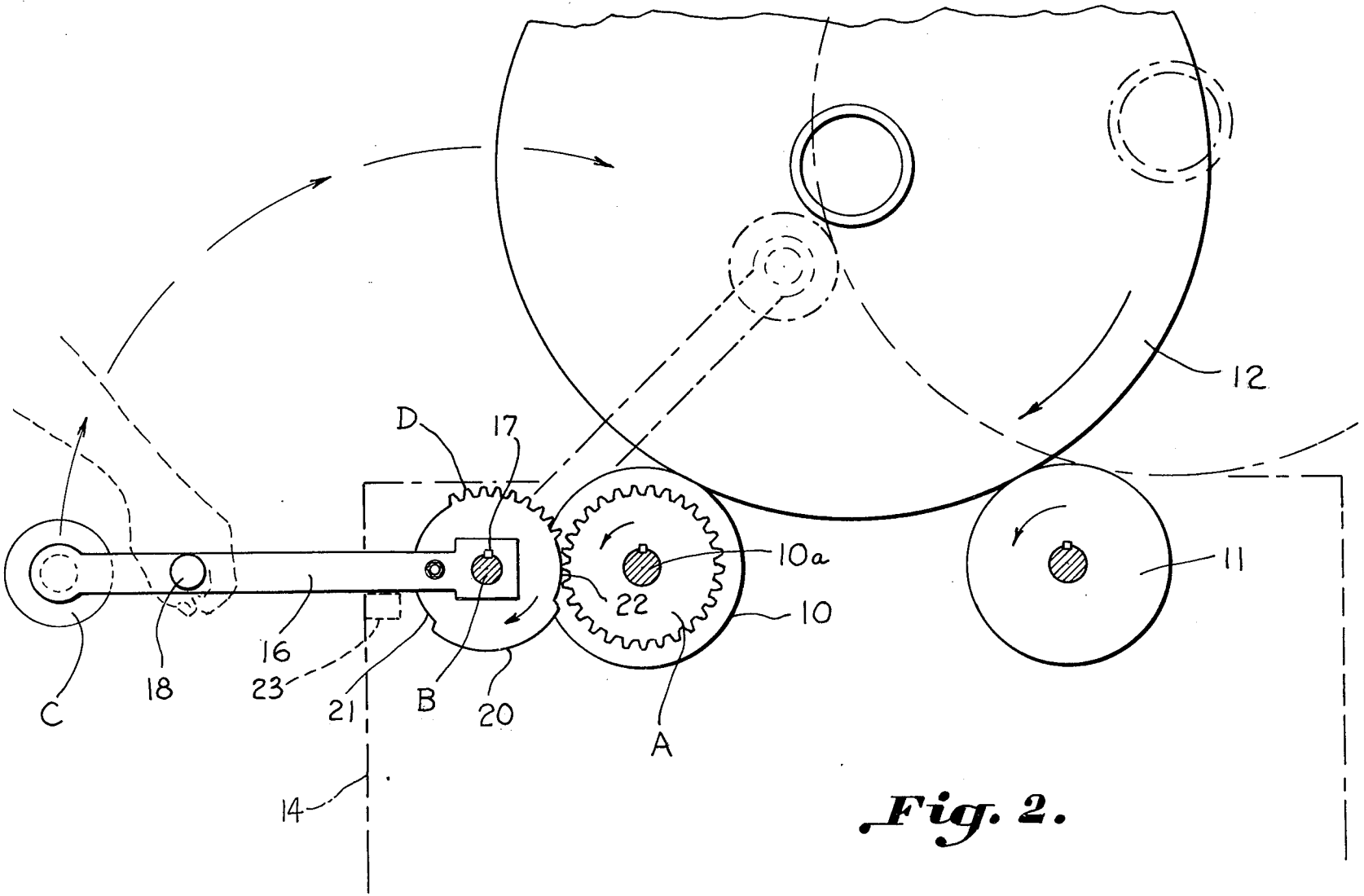
FIG. 2 is an enlarged side elevation illustrating the doffing apparatus of FIG. 1 in greater detail.

The doffing roll C is carried for rotation adjacent one end of the arms 16 which have fixed connection with the shaft B as by a key 17 (FIG. 2). A handle 18 is illustrated as being carried intermediate the ends of the arms 16.

A gear segment D is fixed to the shaft B as by a key 19. The gear segment is cut in a disk and an opposite portion is blank as illustrated at 20 in FIG. 2. Intermediate opposed portions of the disk are reduced as illustrated at 21 and 22, respectively.

A bracket 23 is carried inside the stand 14 for supporting the arm 16 in convenient position to be manually raised to effect a doffing operation. This is accomplished after the cloth roll is fully built and the take-up drive is reversed to turn the rolls in the direction of the arrows in the drawings.

It is thus seen that simplified apparatus has been provided which is manually engagable with the already provided take-up mechanism which is manually engagable when the take-up mechanism is reversed in direction for manually doffing the take-up roll.

While a preferred embodiment of the invention has been described using specific terms, such description is for illustrative purposes only, and it is to be understood that changes and variations may be made without departing from the spirit or scope of the following claims.

What is claimed is:

1. Doffing apparatus for a loom take-up having a pair of driven spaced aligned rolls supporting therebetween a cloth roll which cloth is fed from the loom for winding thereon in a large roll comprising:

a driving gear carried in alignment with and being driven by one of said spaced aligned rolls;

a shaft carried for oscillation in alignment with said spaced aligned rolls;

cloth roll engaging means fixed in laterally spaced alignment with said shaft; and a gear segment carried in fixed relation to said shaft;

whereby said gear segment may be moved into engagement with said driving gear which urges said cloth roll engaging means into engagement with said cloth roll responsive thereto for urging said cloth roll out of its supported position between the spaced aligned rolls.

2. The structure set forth in claim 1 including manual means for raising said cloth roll engaging means thus moving said gear segment into engagement with said driving gear.

3. A doffing apparatus for removing a full cloth roll from spaced aligned take-up rolls having a motor driving means for driving the take-up rolls for building the cloth roll comprising:

cloth roll engagable means carried in laterally spaced alignment with said take-up rolls;

means mounting said cloth roll engagable means for movement out of said laterally spaced alignment into engagement with said cloth roll removing said cloth roll from said take-up rolls; and manually engagable drive means carried by said means mounting said cloth roll engagable means and being movable into driving relation with said take-up rolls for so moving said cloth roll engagable means.

* * * * *